US011396849B2

(12) United States Patent
Tharakan et al.

(10) Patent No.: US 11,396,849 B2
(45) Date of Patent: Jul. 26, 2022

(54) METHODS AND SYSTEMS FOR ENGINE CONTROL

(71) Applicant: Powerhouse Engine Solutions Switzerland IP Holding GmbH, Zug (CH)

(72) Inventors: Atul George Tharakan, Bangalore (IN); James Robert Mischler, Erie, PA (US)

(73) Assignee: Powerhouse Engine Solutions Switzerland IP Holding GmbH, Zug (CH)

( * ) Notice: Subject to any disclaimer, the term of this patent is extended or adjusted under 35 U.S.C. 154(b) by 0 days.

(21) Appl. No.: 17/219,491

(22) Filed: Mar. 31, 2021

(65) Prior Publication Data

US 2022/0010741 A1 Jan. 13, 2022

(30) Foreign Application Priority Data

Jul. 13, 2020 (IN) ..... 202041029635

(51) Int. Cl.
*F02D 41/00* (2006.01)
*F02B 37/007* (2006.01)
(Continued)

(52) U.S. Cl.
CPC ..... *F02D 41/0087* (2013.01); *F02B 37/007* (2013.01); *F02D 41/0082* (2013.01);
(Continued)

(58) Field of Classification Search
CPC ..... F01N 13/107; F01N 2470/14; F01N 2470/16; F02D 41/008–0087;
(Continued)

(56) References Cited

U.S. PATENT DOCUMENTS 7,987,040 B2 * 7/2011 Buckland ..... F02B 37/18 701/103
8,250,866 B2 * 8/2012 Styles ..... F02M 26/08 60/605.2

(Continued)

FOREIGN PATENT DOCUMENTS

DE 10217225 B4 * 10/2008 ..... F01D 25/002
DE 102017118734 A1 2/2018
EP 3569848 A1 11/2019

OTHER PUBLICATIONS

Heintze, DE 10217225, machine translation (Year: 2008).*
Intellectual Property India, Examination Report Issued in Application No. 202041029635, dated Mar. 14, 2022, 5 pages.

*Primary Examiner* — Hung Q Nguyen
*Assistant Examiner* — Mark L. Greene
(74) *Attorney, Agent, or Firm* — McCoy Russell LLP

(57) ABSTRACT

Various methods and systems are provided for dynamically assigning cylinders to cylinder sets in engines having two or more cylinder banks, wherein each cylinder bank is fed intake air by a separate intake manifold, and wherein each cylinder bank includes a separate exhaust manifold. In one example, the current disclosure teaches comparing engine operating conditions against a plurality of predetermined override conditions, and responding to the engine operating conditions matching a predetermined override condition of the plurality of predetermined override conditions by reassigning at least a first cylinder of a first cylinder bank from a first cylinder set to a second cylinder set, and adjusting an operating parameter of the second cylinder set and first cylinder set based on the override condition. In this way, cylinders may be dynamically assigned to cylinder sets based, from a default cylinder set, based on occurrence of predetermined override conditions.

20 Claims, 5 Drawing Sheets

(51) Int. Cl.

| | |
|---|---|
| ***F02D 41/06*** | (2006.01) |
| ***F02D 41/14*** | (2006.01) |
| ***F02D 41/18*** | (2006.01) |
| *F01N 13/10* | (2010.01) |
| *F02M 35/10* | (2006.01) |

(52) U.S. Cl.
CPC ..... *F02D 41/0085* (2013.01); *F02D 41/062* (2013.01); *F02D 41/1446* (2013.01); *F02D 41/1454* (2013.01); *F02D 41/182* (2013.01); *F01N 13/107* (2013.01); *F02D 41/1443* (2013.01); *F02D 2200/0406* (2013.01); *F02D 2200/1002* (2013.01); *F02M 35/10045* (2013.01)

(58) Field of Classification Search
CPC ..... F02D 41/062; F02D 41/1443; F02D 41/1446; F02D 41/1454; F02D 41/182; F02M 35/10026
See application file for complete search history.

(56) References Cited

U.S. PATENT DOCUMENTS

| | | | | |
|---|---|---|---|---|
| 9,416,743 | B2 * | 8/2016 | Beikmann | F02D 41/0087 |
| 9,976,499 | B2 | 5/2018 | Freund et al. | |
| 2011/0023482 | A1 | 2/2011 | Styles et al. | |
| 2014/0090623 | A1 | 4/2014 | Beikmann | |
| 2019/0218979 | A1 * | 7/2019 | Glugla | F02D 17/02 |
| 2019/0338720 | A1 * | 11/2019 | Banker | F02D 41/3082 |

* cited by examiner

METHODS AND SYSTEMS FOR ENGINE CONTROL

CROSS REFERENCE TO RELATED APPLICATIONS

The present application claims priority to Indian Patent Application No. 202041029635, entitled "METHODS AND SYSTEMS FOR ENGINE CONTROL", and filed on Jul. 13, 2020. The entire contents of the above-listed application are hereby incorporated by reference for all purposes.

BACKGROUND

Technical Field

Embodiments of the subject matter disclosed herein relate to engine control. In particular, systems and methods for dynamically grouping cylinders in multi-cylinder bank engines based on engine operating conditions.

Discussion of Art

Vehicles, such as rail vehicles, include power sources, such as diesel internal combustion engines. An internal combustion engine may be configured as a split engine system including a plurality of cylinders which may be arranged in one or more cylinder banks. Each cylinder bank may include at least one cylinder. Each cylinder in a cylinder bank may be coupled to an intake valve, an exhaust valve and a fuel injector. Based on engine operating conditions, power output of an engine may be adjusted by adjusting an amount of fuel delivered to the engine cylinders and a timing of fuel injection to the engine cylinders.

BRIEF DESCRIPTION

In one embodiment, a method may include assigning a first plurality of cylinders of a first cylinder bank to a first cylinder set, wherein the first cylinder bank may include a first intake manifold, assigning a second plurality of cylinders of a second cylinder bank to a second cylinder set, wherein the second cylinder bank may include a second intake manifold separate from the first intake manifold, estimating engine operating conditions, comparing the engine operating conditions against a plurality of predetermined override conditions, and responding to the engine operating conditions matching a predetermined override condition of the plurality of predetermined override conditions by reassigning at least a first cylinder of the first plurality of cylinders of the first cylinder bank to the second cylinder set, and adjusting an operating parameter of the second cylinder set and the first cylinder set based on the predetermined override condition.

DETAILED DESCRIPTION

Figure 1:
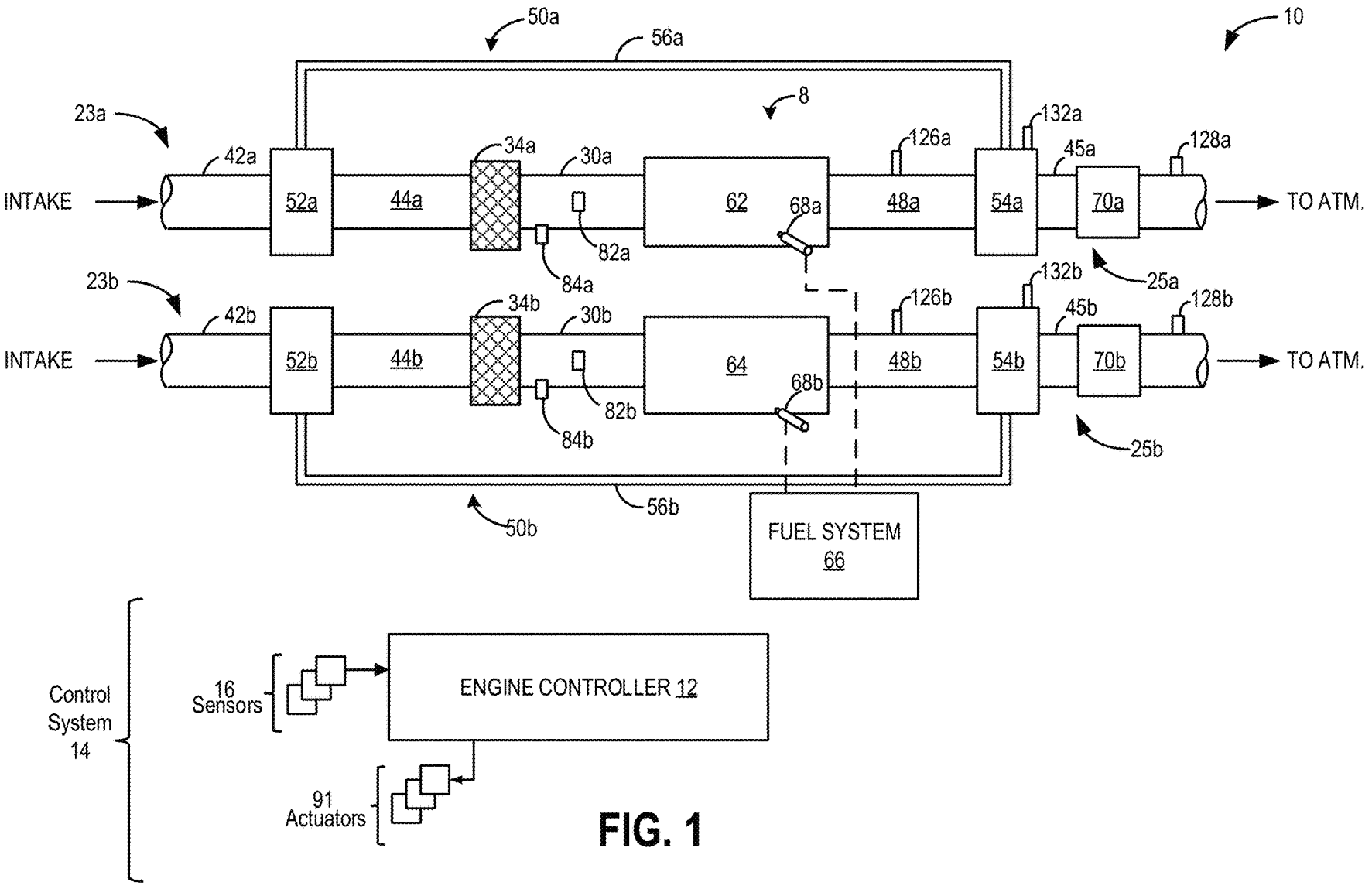
FIG. 1 shows a schematic diagram of an engine having a first cylinder bank and a second cylinder bank, served by separate intake manifolds and exhaust manifolds.

The following description relates to dynamically grouping cylinders in a split engine systems based on engine operating conditions. One example of such an engine system is illustrated in FIG. 1, wherein the engine includes two banks of cylinders. An engine controller may be configured to perform a control routine, such as the example routine of FIG. 2 to for dynamically group cylinders in response to occurrence of predetermined override conditions. Examples of assignment of cylinders to distinct groups based on engine operating conditions and operation of each group of cylinders is shown in example tables of FIGS. 3-5.

A split engine may include two or more engine banks with each bank including one or more engine cylinders. As such, each cylinder in a cylinder bank may be grouped and operated with a same set operating parameter such as an equal amount of fuel may be supplied to each cylinder in a cylinder bank at an injection timing. The total power output of an engine is the sum of all the power produced by the individual cylinders. Ideally, each bank of cylinders will generate identical power output levels for identical operating conditions such as fuel quantity, injection timing, air intake, etc.

The inventors herein have recognized potential issues with operating all cylinders in a cylinder bank with identical operating conditions. As an example, due to degradation of one or more engine components such as leaks in engine/exhaust valves in one or more cylinders, power output of a bank may reduce. Also, malfunction of a turbocharger component or an associated cooler may result in difference in boost pressure between two cylinder banks. An imbalance of power output between cylinder banks may result from such degradations and malfunctions associated with a bank. An imbalance in power output between cylinder banks as applied to the crankshaft and output shaft may result in increased noise-vibration-harshness (NVH) concerns.

In one example, the issues described above may be at least partially addressed by a method for an engine, comprising: assigning a first plurality of cylinders of a first cylinder bank to a first cylinder set, assigning a second plurality of cylinders of a second cylinder bank to a second cylinder set, wherein the first cylinder bank comprises a first intake manifold and the second cylinder bank comprises a second intake manifold separate from the first intake manifold, estimating engine operating conditions, comparing the engine operating conditions against a plurality of predetermined override conditions, and responding to the engine operating conditions matching a predetermined override condition of the plurality of predetermined override conditions by: reassigning at least a first cylinder of the first plurality of cylinders of the first cylinder bank to the second cylinder set, and adjusting an operating parameter of the second set and first cylinder set based on the override condition. In this way, by dynamically grouping cylinders belonging to different cylinder banks based on engine operating conditions and adjusting operating parameters for each cylinder group separately, engine operation may be improved.

As one example, an engine may include a first, left bank and a second, right bank, each bank coupled to a separate intake manifold and a separate exhaust manifold. A separate turbocharger may be coupled to each cylinder bank. Distinct pressure sensors, temperature sensors, and turbo speed sensors are coupled to each manifold. During engine operation without the presence of predefined conditions (referred herein as override conditions), all engine cylinders in both banks are fueled uniformly. During presence of an override condition such as temperature of an exhaust port of a cylinder decreasing to below a temperature threshold, the cylinders in both the engine banks may be regrouped to two or more sets. Cylinders from both engine banks may be part of both groups and number of cylinders in the first group of cylinders and the second group of cylinders make up a total number of cylinders of the engine. Engine operating parameters such as an amount of fuel injected and a time of fuel injection may be varied between the two cylinder groups.

In this way, by dynamically assigning cylinders to groups regardless of their position within a cylinder bank, engine operating parameters may be tuned for each group to obtain an optimal power output from the engine. Grouping of cylinders facilitates in balancing power output of two cylinder banks, thereby reducing NVH concerns. The technical effect of adjusting fueling between cylinder groups is that variation in emissions between two cylinder banks may be reduced. Further, turbocharger surge in a cylinder bank may be mitigated by selectively adjusting fueling and boost pressure in each cylinder group. Overall, by selectively adjusting engine operations of cylinder groups based on engine operating conditions and performance of components coupled to each cylinder group, fuel consumption may be reduced and emissions quality may be improved.

FIG. 1 depicts a split engine system 10 that may be included in a vehicle or vehicle system, such as a locomotive. Split engine system 10 may include a split engine 8 with a first bank of cylinders 62 and a second bank of cylinders 64. In this example, engine 8 may be a diesel engine. However, in alternate embodiments, alternate engine configurations may be employed, such as a gasoline engine, a biodiesel engine, or a natural gas engine, for example.

Engine 8 includes a first intake system 23*a* and a second intake system 23*b* independent of each other. A first intake passage 42*a* leading to a first intake manifold 44*a* and a first intake 30*a* may be coupled to the first bank 62. A second intake passage 42*b* leading to a second intake manifold 44*b* and a second intake 30*b* may be coupled to the second bank 64. Engine 8 may also include a first exhaust system 25*b* and a second exhaust system 25*b* independent of each other. The first bank 62 may be coupled to a first exhaust manifold 48*a* leading to a first exhaust passage 45*a* and the second bank 64 may be coupled to a second exhaust manifold 48*b* leading to a second exhaust passage 45*b* that routes exhaust gas to the atmosphere. Each of the first exhaust passage 45*a* and second exhaust passage 45*b* may include one or more emission control devices 70*a* and 70*b* respectively, which may be mounted in a close-coupled position in the respective exhaust passage. One or more emission control devices 70*a* and 70*b* may include a three-way catalyst, lean NOx trap, oxidation catalyst, etc.

Engine 8 may further include a pair of boosting devices, such as a first turbocharger 50*a*, including a first compressor 52*a* arranged along first intake passage 42*a* and a second turbocharger 50*b*, including a second compressor 52*b* arranged along second intake passage 42*b*. The first compressor 52*a* may be at least partially driven by a first turbine 54*a* arranged along first exhaust passage 45*a*, via a first shaft 56*a* and the second compressor 52*b* may be at least partially driven by a second turbine 54*b* arranged along the second exhaust passage 45*b*, via a second shaft 56*b*. In alternate embodiments, the boosting devices may be a supercharger, wherein compressors 52*a* and 52*b* may be at least partially driven by the engine and/or an electric machine, and may not include a corresponding turbine.

The first turbocharger 50*a* and the second turbocharger 50*b* may operate independent of each other to provide boost pressure to the first bank 62 and second bank 64 respectively. Compressed air from the first compressor 52*a* may be directed to the first bank 62 via a first intercooler 34*a* housed in the first intake 30*a* to reduce the temperature of the boosted air charge supplied to the first bank 62 of cylinders. Compressed air from the second compressor 52*b* may be directed to the second bank 64 via a second intercooler 34*b* housed in the second intake 30*b* to reduce the temperature of the boosted air charge supplied to the second bank 64 of cylinders.

A first intake manifold air temperature (MAT) sensor 82*a* and a first intake manifold air pressure (MAP) sensor 84*a* may be positioned downstream of first intercooler 34*a* in first intake 30*a* to estimate a first temperature and first pressure, respectively, of intake air supplied to first bank of cylinders 62. A second MAT sensor 82*b* and a second MAP sensor 84*b* may be positioned downstream of second intercooler 34*b* in second intake 30*b* to estimate a second temperature and second pressure, respectively, of intake air supplied to second bank of cylinders 64. A first pre-turbine temperature sensor 126*a* may be positioned upstream of first turbine 54*a* in first exhaust manifold 48*a* and a second pre-turbine temperature sensor 126*b* may be positioned upstream of second turbine 54*b* in second exhaust manifold 48*b*. The first turbine 54*a* may include a first turbine speed sensor 132*a* and the second turbine 54*b* may include a second turbine speed sensor 132*b*.

In one example, engine 8 may include an exhaust gas recirculation (EGR) system wherein exhaust gas from one or both exhaust manifold may be recirculated to the intake manifold. High-pressure EGR may be supplied from upstream of the exhaust turbine to downstream of the intake compressor while a low-pressure EGR may be supplied from downstream of the exhaust turbine to upstream of the intake compressor. One of the first cylinder bank 62 and the second cylinder bank 64 that is adapted with an EGR system may be termed as a donor bank (with donor cylinders) while the other bank may be the non-donor bank.

A fuel system 66 may supply fuel to each of the first bank 62 and the second bank 64 via fuel injectors to each cylinder in each bank. The fuel system 66 may comprise a common rail injection system with a one/two high pressure fuel pumps and corresponding inlet metering valve. In this example, a first injector 68*a* is shown to supply fuel to a cylinder in the first bank and a second injector 68*b* is shown to supply fuel to another cylinder in the second bank 64. Each cylinder in each of the first bank 62 and the second bank 64 may be coupled to a fuel injector. As an example, in an engine including 16 cylinders (divided in two banks), the fuel system may include 16 fuel injectors with each injector coupled to a distinct cylinder.

Engine 8 may be controlled at least partially by control system 14 including engine controller 12, locomotive controller 22, and by input from a vehicle operator via an input device (not shown). Engine controller 12 is shown receiving information from a plurality of engine sensors 16 (various examples of which are described herein) and sending control signals to a plurality of engine actuators 91 (various examples of which are described herein). As one example, engine sensors 16 may include pre-turbine temperature sensors 126*a*, 126*b*, exhaust temperature sensors 128*a*, 128*b* located downstream of emission control devices 70*a*, 70*b*, MAP sensors 84*a* and 84*b*, and MAT sensors 82*a* and 82*b*.

Various other sensors such as additional pressure, temperature, air/fuel ratio and composition sensors may be coupled to various locations in split engine system 10. As another example, engine actuators 91 may include fuel injectors 68*a*, 68*b* of fueling system 66, and throttles, if equipped. Other actuators, such as a variety of additional valves, may be coupled to various locations in split engine system 10. Engine controller 12 may receive input data from the various engine sensors, process the input data, and trigger the engine actuators in response to the processed input data based on instruction or code programmed therein corresponding to one or more routines. An example control routine for adjusting operation of engine cylinders is described herein with regard to FIG. 2.

Engine operating conditions of the first cylinder bank and the second cylinder bank may be estimated based on inputs from the above mentioned engine sensors, and the engine operating conditions of the first cylinder bank and the second cylinder bank may be compared against a plurality of predetermined override conditions. In response to the engine operating conditions of the first cylinder bank and the second cylinder bank matching a predetermined override condition of the plurality of predetermined override conditions, the engine cylinders may be dynamically grouped regardless of their positions in the cylinder banks. At least a first cylinder of the first plurality of cylinders of the first cylinder bank may be reassigned from a first cylinder set to a second cylinder set. A vector of cylinder assignments may be retrieved from a location of non-transitory memory associated with the predetermined override condition, the vector of cylinder assignments may include a plurality of entries, each of the plurality of entries indicating a set assignment for a corresponding cylinder of the first plurality of cylinders and the second plurality of cylinders. An operating parameter of the second cylinder set and first cylinder set may be adjusted based on the override condition. Examples of override conditions may include an exhaust port of the first cylinder decreasing to below a temperature threshold and a dynamic skip-fire request for the first cylinder.

Further, responding to the engine operating conditions not matching at least one predetermined override conditions, operating conditions of the first cylinder bank may be compared with operating conditions of the second cylinder bank. In response to a difference in at least one operating condition between the first cylinder bank and the second cylinder bank by: at least a first operating parameter of the first cylinder set may be adjusted to a first value and at least the first operating parameter of the second cylinder set may be adjusted to a second value, the first value not being equal to the second value.

Adjusting operating conditions for the first and second set of cylinders may include adjustment of an amount of fuel injected to each cylinder set and an injection timing (for each cylinder set (such as adjusting a start of injection timing, and/or adjusting an end of injection timing). Even while maintaining the amount of fuel injection at the same desired level, the timing of when, in relation to piston motion or the combustion cycle, the fuel is delivered, may be adjusted. The injection timing relative to the piston motion may be delayed (retarded), or advanced, by delaying or advancing both the opening and closing of the injector opening. By adjusting fueling, power output of each cylinder set may be adjusted.

Figure 2:
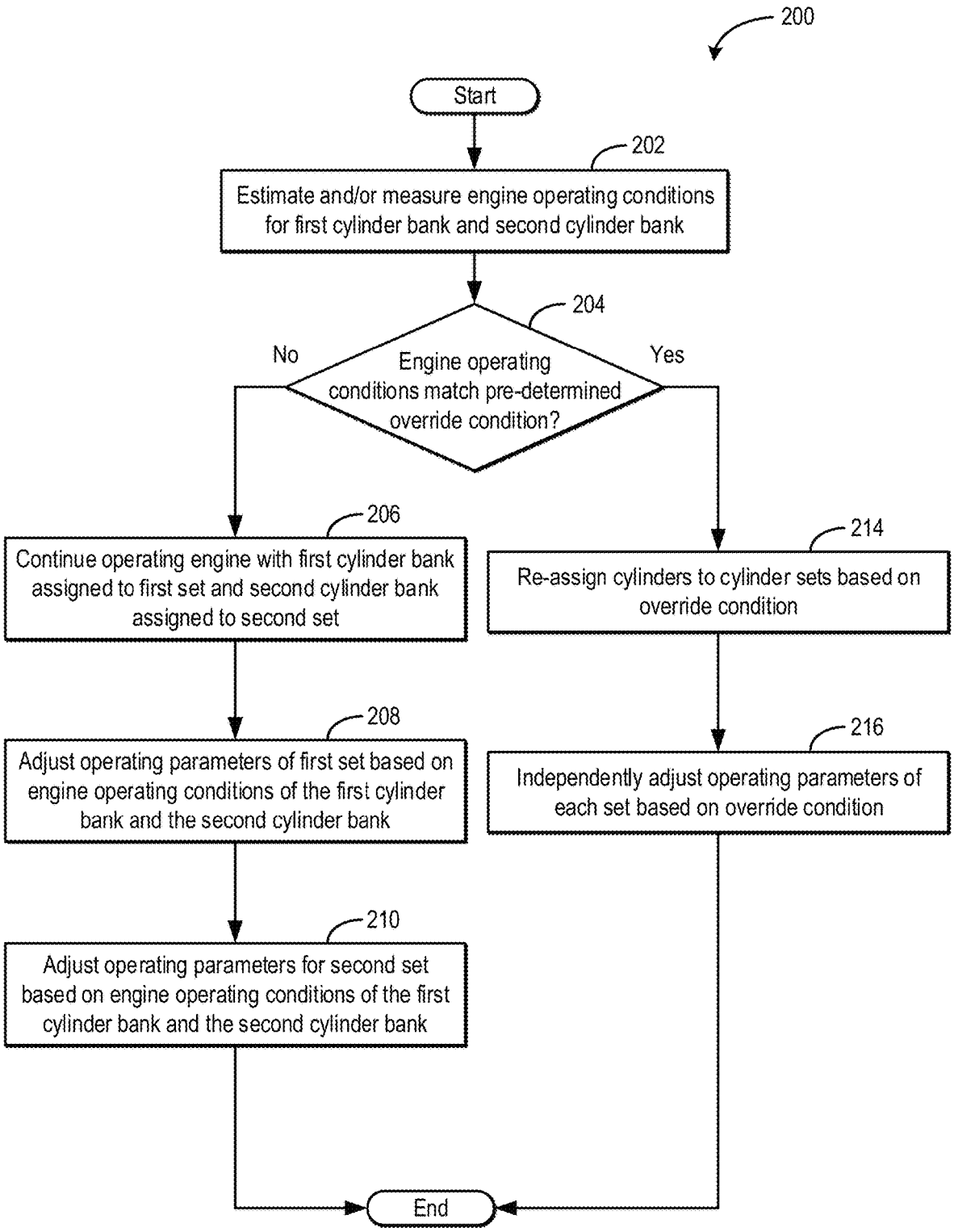
FIG. 2 shows a flowchart of an example method for dynamically grouping cylinders in response to occurrence of predetermined override conditions.

FIG. 2 shows a method 200 for dynamically grouping cylinders of an engine (such as an engine 8 in FIG. 1) in response to occurrence of predetermined override conditions and adjusting a makeup of the groups. The engine may include cylinders divided into two banks with each cylinder being assigned to either a first cylinder bank or a second cylinder bank. Each cylinder bank may be coupled to a distinct intake manifold, exhaust manifold, and turbocharger. Instructions for carrying out method 200 and the rest of the methods included herein may be executed by a controller (e.g., controller 12 shown in FIG. 1) based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 202, engine operating conditions for each cylinder in the first cylinder bank and the second cylinder bank may be estimated and/or measured. Engine operating conditions may include engine speed, engine load (e.g., such as notch level), cylinder pressures (such as MEP and/or peak cylinder pressure), MAF (mass air flow), MAP (intake manifold air pressure), MAT (intake manifold air temperature), boost level, pre-turbine temperature, turbine speeds for each cylinder bank.

At 204, the routine includes determining if the current engine operating conditions match a predetermined override condition. A predetermined override condition may include exhaust temperature of one or more cylinders reducing below a threshold temperature. The threshold temperature may be a pre-calibrated temperature below which emissions quality may deteriorate. An override condition may further include a dynamic skip-fire request for one more engine cylinders. During conditions when it is possible to operate the engine at a lower than maximum permissible engine power output, a skip-fire request may be made by the controller to reduce fuel consumption and improve emissions quality. An override condition may also include diagnostic tests being carried out such dead cylinder detection and engine pop test.

If it is determined that the current engine operating conditions match a predetermined override condition, at 214, cylinder sets may be reassigned based on the override condition. A set (also referred herein as group or bin) may include one or more cylinders. As an example, if the override condition requests one or more cylinders belonging to the same or different banks to be operated with parameters different from the rest of the engine cylinders, the one or more cylinders may be grouped as a first set while the remaining cylinders may be grouped as second set.

In one example, there may be two sets of cylinders. In another example, there may be one set of cylinders or more than two sets of cylinders (up to a number that equals the total number of cylinders of the engine). All cylinders of the engine may be either in the first set of cylinders or the second set of cylinders (or however many groups are being used). For example, all cylinders of the engine may be in the first set and no cylinders may be in the second set (such as during an engine start). In another example, if the engine includes sixteen total cylinders, ten cylinders may be in the first set and the remaining six cylinders may be in the second set. In this way, the two sets (or fixed number of sets) include all the engine cylinders. As such a cylinder may form its own set, thereby forming sixteen sets in a sixteen-cylinder engine.

While the methods herein are discussed with only two sets of cylinders, in alternate embodiments, there may be more than two sets of cylinders which all the cylinders are split up into and which receive fuel corresponding to requirements of each set. Each set of cylinders may be operated as a group regardless of their original assignment or position within the cylinder banks.

At 216, operating parameters for each set of cylinders may be independently adjusted based on the override condition. Adjustment of operating parameters may include adjustment of fueling parameters including an amount of fuel injected (or a rate of fuel delivery) and a timing of fuel injection of the second set of cylinders. Variation in the amount of fuel injected and the timing of fuel injection relative to a current piston position and crankshaft angle may result in variation in power output of the cylinders. Injection timing may be measured relative to a top dead center (TDC) position of the piston in the cylinder. An increase in power output of a cylinder may be achieved by increasing an amount of fuel injected and advancing fuel injection timing relative to TDC.

In addition to variation in the rate of fuel delivery and a timing of fuel injection of a set of cylinders, other adjustments to fuel injection such as adjusting a number of injection events (multiple injections) may be carried out. As an example, selective pilot injection may be carried out in one set of cylinders to compensate for lower power output (such as caused due to degradation of one or more components). Timing and quantity of fuel injected in the pilot injection may also be varied. Further, selective post injection may be carried out in one set of cylinders to compensate for lower power output (such as caused due to degradation of one or more components). Timing and quantity of fuel injected in the post injection may also be varied.

Figure 3:
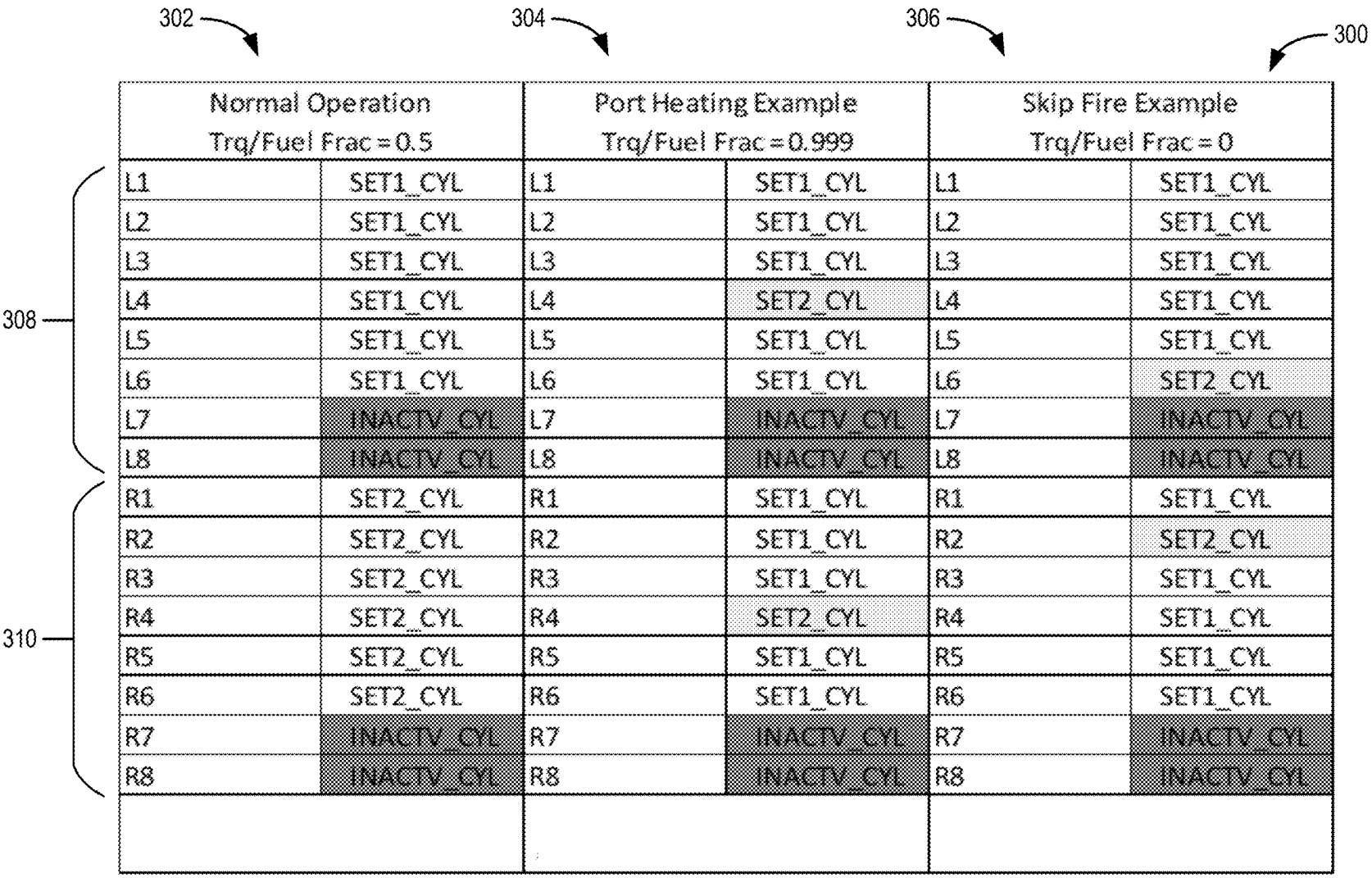
FIG. 3 shows an example of dynamically assigning cylinders based on engine operating conditions.

FIG. 3 shows an example table 300 of dynamically assigning cylinders in a twelve-cylinder engine based on an override condition. A first group of rows designated by 308 may include eight cylinders belonging to a first cylinder bank (such as cylinder bank 62 in FIG. 1) and a second group of rows designated by 310 may include another eight cylinders belonging to a second cylinder bank (such as cylinder bank 64 in FIG. 1). The cylinders in the first bank are denoted by L1-L6 and the cylinders in the second bank are denoted by R1-R6. In this example, additional cylinders L7-L8 (in first bank) and cylinders R7-R8 (in second bank) are shown as inactive cylinders that are not fueled for power generation. The first column 302 of the table 300 shows grouping and operation of the engine cylinders in absence of any override condition. The second column 304 of the table 300 shows grouping and operation of the engine cylinders in response to a first override condition. The third column 306 of the table 300 shows grouping and operation of the engine cylinders in response to a second override condition.

As shown in the first column 302, cylinders L1-L6 are grouped as a first set (set 1) of cylinders and cylinders R1-R6 are grouped as a second set (set 2) of cylinders. The grouping is based on the positioning of the cylinders in the engine banks. During this operation, fueling is not altered based on an override condition. Fueling may be carried out with a uniform torque/fuel fraction of 0.5 for each engine cylinder (in both banks). Also, timing of fuel injection is not adjusted for any of the cylinders. The controller may use a lookup table to determine an amount of fuel to be injected to obtain a torque/fuel fraction of 0.5 in a cylinder with the torque/fuel fraction as input and an amount of fuel to be injected from the common fuel rail as an output. Fuel fraction may be a fraction of air charge that is combusted in the cylinder to attain a torque. An amount of torque generated may be directly proportional to the fuel causing the fuel fraction to be equal to a torque fraction.

The first override condition may include exhaust temperatures of exhaust ports coupled to two engine cylinders decreasing to below the threshold temperature. In this example, the cylinders L4 (in first bank) and R4 (in second bank) may experience a lower exhaust temperature. Due to the decrease in exhaust port temperature, heating of the two corresponding exhaust ports is desired. As shown in second column 304, cylinders L4 and R4 are grouped together as second set (set 2) and all other cylinders of both the first bank and the second bank are grouped together as first set (set 1). The two cylinders in set 2 may be operated with a torque/fuel fraction of 0.999 while the cylinders of set 1 may be operated with a torque/fuel fraction of 0.001. The controller may use a lookup table to determine an amount of fuel to be injected to obtain a torque/fuel fraction of 0.999 in the set two cylinders with the torque/fuel fraction as input and an amount of fuel to be injected from the common fuel rail as an output. The torque/fuel fraction for the second set may be increased by increasing an amount of fuel injected to the cylinders in the second set. By increasing the amount of fuel injected, a higher amount of heat may be generated in the cylinders of the second set which may increase the temperature of the respective exhaust ports to above the threshold temperature while maintaining the exhaust temperature of all other cylinders.

Port heating may be carried out dynamically for all the cylinders in a sequence by dynamically reassigning the cylinders till all cylinders are done. Port heating cleans the exhaust manifolds of oil/fuel accumulation. As an example, after port heating is complete on a first set (of one or more cylinders) of cylinders, one or more other cylinders are dynamically reassigned and the new set of cylinders are heated and the exhaust manifold is cleaned. In this way, the in exhaust temperatures of the engine is increased to avert oil/fuel souping and accumulation in the exhaust manifold.

The second override condition may include a skip-fire request to reduce the total power output of the engine. A skip-fire request may be made when the engine is operated at a lower torque demand. In this example, the cylinders L6 (in first bank) and R2 (in second bank) may be requested to skip-fire such that combustion will not be carried out in these cylinders. As shown in third column 306, cylinders L6 and R2 are grouped together as second set (set 2) and all other cylinders of both the first bank and the second bank are grouped together as first set (set 1). The two cylinders in set 2 may be operated with a torque/fuel fraction of 0 while the cylinders of set 1 may be operated with a torque/fuel fraction of 1. Operating the set 2 cylinders with a torque/fuel fraction of 0 includes suspending fueling in the set 2 cylinders such that power is not generated in the selected cylinders while combustion is carried out in all other cylinders. In this way, by selectively grouping cylinders, it is possible to operate different sets of cylinders based on dynamic engine operating conditions for desired fuel efficiency and emissions quality.

Skip fire may also be carried out dynamically for all the cylinders in a sequence by dynamically reassigning the cylinders till all cylinders are done. As an example, after skipping fire on a first set (of one or more cylinders) of cylinders, one or more other cylinders are dynamically reassigned and the new set of cylinders are with a torque/fuel fraction of 0.

Returning to FIG. 2, if at 204 it is determined that the engine operating conditions do not match any predetermined override condition, the routine may proceed to 206 where engine operation may be continued with all cylinders in the first bank being grouped as a first set (set 1) and all cylinders in the second bank being grouped as a second set (set 2). Engine operating conditions for each set (cylinder bank in this case) may be adjusted based on relative conditions and degradations (if any) of each cylinder block. As an example, an intercooler (such as intercooler 34*a* or 34*b*) cooling compressed air supplied to one engine bank may be degraded causing a decrease in boost pressure for cylinders in that bank while cylinders at the other bank may operate with desired boost pressure. Due to degradation of a component specific to a bank, power output of a bank may be lower relative to the power output of the other bank which is desired to be balanced. Adjustment of operating parameters for one bank may include adjustment of fueling parameters including an amount of fuel injected and a timing of fuel injection for that bank.

At 208, operating conditions such as an amount of fuel injected (or a rate of fuel delivery) and injection timing for cylinders in the first set may be adjusted based on operating conditions of each of the first bank and the second bank. Also, at 210, operating conditions such as an amount of fuel injected (or a rate of fuel delivery) and injection timing for cylinders in the second set may be adjusted based on operating conditions of each of the first bank and the second bank. As an example, in order to estimate a difference in output of the first cylinder and bank and the second cylinder bank, a first intake air flowrate of the first intake manifold coupled to the first engine bank may be compared to a second intake air flowrate of the second intake manifold coupled to the second engine bank, a first torque output of the first cylinder bank may be compared to a second torque output of the second cylinder bank, and a first exhaust temperature of the first exhaust manifold may be compared to a second exhaust temperature of the second exhaust manifold.

In addition to variation in the rate of fuel delivery and a timing of fuel injection of a set of cylinders in a cylinder bank, other adjustments to fuel injection such as adjusting a number of injection events (multiple injections) may be carried out. As an example, selective pilot injection may be carried out in cylinder bank to compensate for lower power output (such as caused due to degradation of one or more components). Timing and quantity of fuel injected in the pilot injection may also be varied. Further, selective post injection may be carried out in one cylinder bank to compensate for lower power output (such as caused due to degradation of one or more components). Timing and quantity of fuel injected in the post injection may also be varied.

Figure 4:
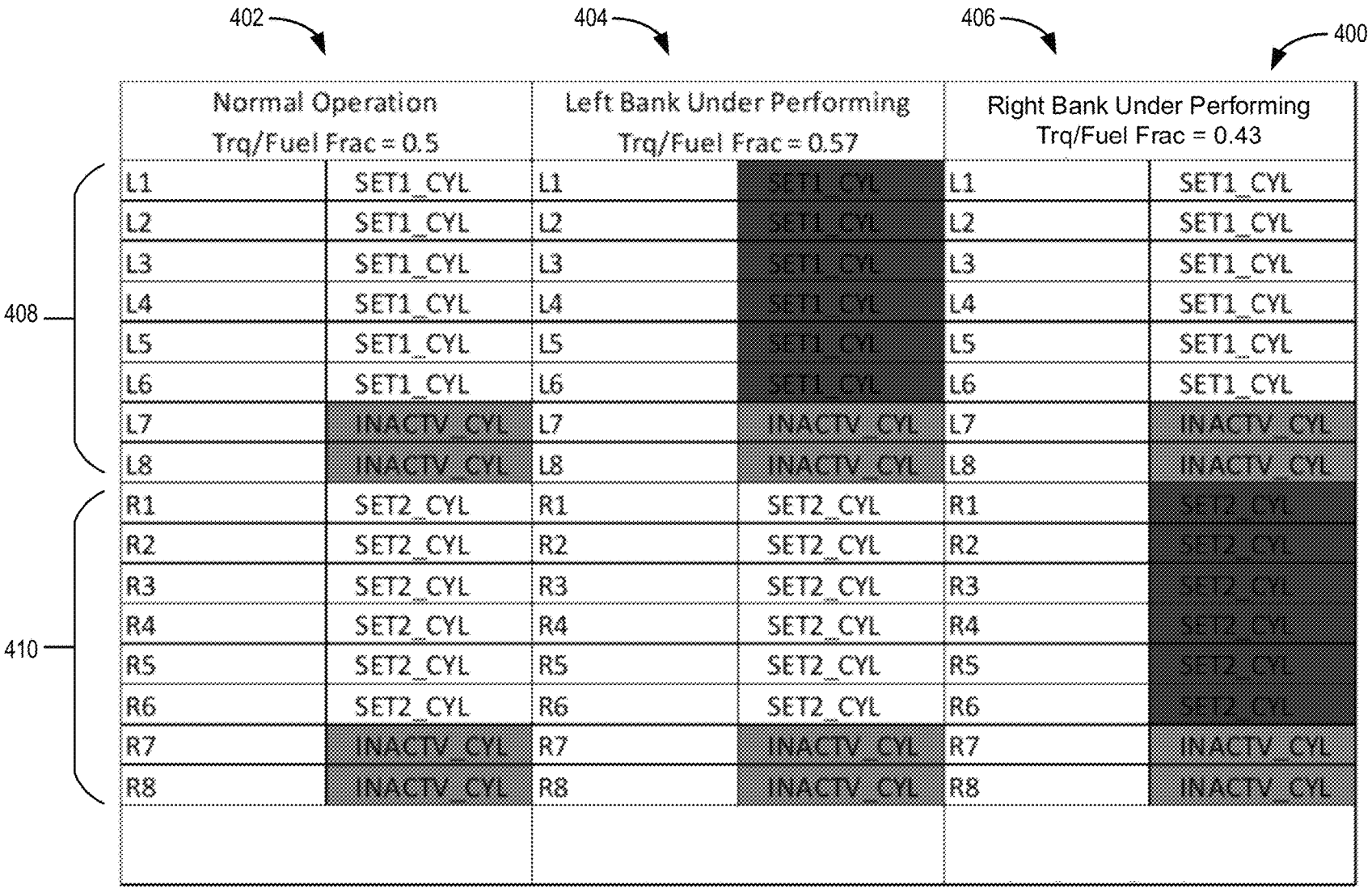
FIG. 4 shows an example of adjusting fueling to engine cylinders based on engine operating conditions.

FIG. 4 shows a first example table 400 of adjusting fueling in a cylinder bank based on operating conditions of both cylinder banks. A first group of rows designated by 408 may include eight cylinders belonging to a first cylinder bank (such as cylinder bank 62 in FIG. 1) and a second group of rows designated by 410 may include another eight cylinders belonging to a second cylinder bank (such as cylinder bank 64 in FIG. 1). The cylinders in the first bank are denoted by L1-L6 and the cylinders in the second bank are denoted by R1-R6. In this example, additional cylinders L7-L8 (in first bank) and cylinders R7-R8 (in second bank) are inactive cylinders that are not fueled for power generation. The first column 402 of the table 400 shows operation of the engine cylinders when both cylinder banks are operating under similar operating conditions without any indication of degradation or power imbalance between banks. The second column 404 of the table 400 shows fueling of the engine cylinders in response to the first cylinder bank underperforming relative to the second cylinder bank causing power imbalance between the two banks. The third column 406 of the table 400 shows fueling of the engine cylinders in response to the second cylinder bank underperforming relative to the first cylinder bank causing power imbalance between the two banks.

As shown in the first column 402, cylinders L1-L6 are grouped as a first set (set 1) of cylinders and cylinders R1-R6 are grouped as a second set (set 2) of cylinders based on the positioning of the cylinders in the engine banks. Since both cylinder banks operate uniformly, fueling is not altered. Fueling may be carried out with a uniform torque/fuel fraction of 0.5 for each engine cylinder (in both banks). A substantially equal amount of fuel may be injected to each cylinder via a fuel injector coupled to the respective cylinder to attain a torque/fuel fraction of 0.5 for each engine cylinder. The controller may use a lookup table to determine an amount of fuel to be injected to obtain a torque/fuel fraction of 0.5 in a cylinder with the torque/fuel fraction as input and an amount of fuel to be injected from the common fuel rail as an output. Fuel fraction may be a fraction of air charge that is combusted in the cylinder to attain a torque. An amount of torque generated may be directly proportional to the fuel causing the fuel fraction to be equal to a torque fraction.

As shown in second column 404, fueling in the engine cylinders may be adjusted due to the first cylinder bank underperforming such as the power output of the first bank being lower than desired. The underperformance of the one engine bank while the other bank continues to operate optimally may arise due to degradation of a component (such as turbocharger, intercooler etc.) coupled to the underperforming bank. All the cylinders, L1-L6, of the first bank are grouped together as first set (set 1) and all cylinders of the second bank, R1-R6, are grouped together as second set (set 2).

The cylinders in set 1 (first bank cylinders) may be operated with a torque/fuel fraction of 0.57 while the cylinders of set 2 (second bank cylinders) may be operated with a torque/fuel fraction of 0.43. The increase in the fuel/torque fraction for the first set relative to the second set may be determined as a function of a difference in power output of the first bank relative to the second bank as estimated based on sensor outputs (such as exhaust temperature sensor, MAP, etc.) from each of the first bank and the second bank. The controller may use a lookup table to determine an amount of fuel to be injected to obtain a torque/fuel fraction of 0.57 in a cylinder with the torque/fuel fraction as input and an amount of fuel to be injected from the common fuel rail as an output. An increase in torque/fuel fraction is proportional to an increase in the amount of fuel injected. By increasing the torque/fuel fraction in the cylinders of the first bank relative to the cylinders in the second bank, the power output of the cylinders in the first bank may be increased, thereby offsetting the underperformance of the first bank cylinders. In this way, by selectively increases the amount of fuel injected to one cylinder bank, power balance between cylinders may be attained.

As shown in second column 406, fueling in the engine cylinders may be adjusted due to the second cylinder bank underperforming such as the power output of the second bank being lower than desired. All the cylinders of the first bank, L1-L6, are grouped together as first set (set 1) and all cylinders of the second bank, R1-R6, are grouped together as second set (set 2).

The cylinders in set 1 (first bank cylinders) may be operated with a torque/fuel fraction of 0.43 while the cylinders of set 2 (second bank cylinders) may be operated with a torque/fuel fraction of 0.57. The increase in the fuel/torque fraction for the second set relative to the first set may be determined as a function of a difference in power output of the second bank relative to the first bank as estimated based on sensor outputs (such as exhaust temperature sensor, MAP, etc.) from each of the first bank and the second bank. The controller may use a lookup table to determine an amount of fuel to be injected to obtain a torque/fuel fraction of 0.57 in a cylinder with the torque/fuel fraction as input and an amount of fuel to be injected from the common fuel rail as an output. An increase in torque/fuel fraction is proportional to an increase in the amount of fuel injected. By increasing the torque/fuel fraction in the cylinders of the second bank relative to the cylinders in the first bank, the power output of the cylinders in the second bank may be increased, thereby offsetting the underperformance of the second bank cylinders.

Figure 5:
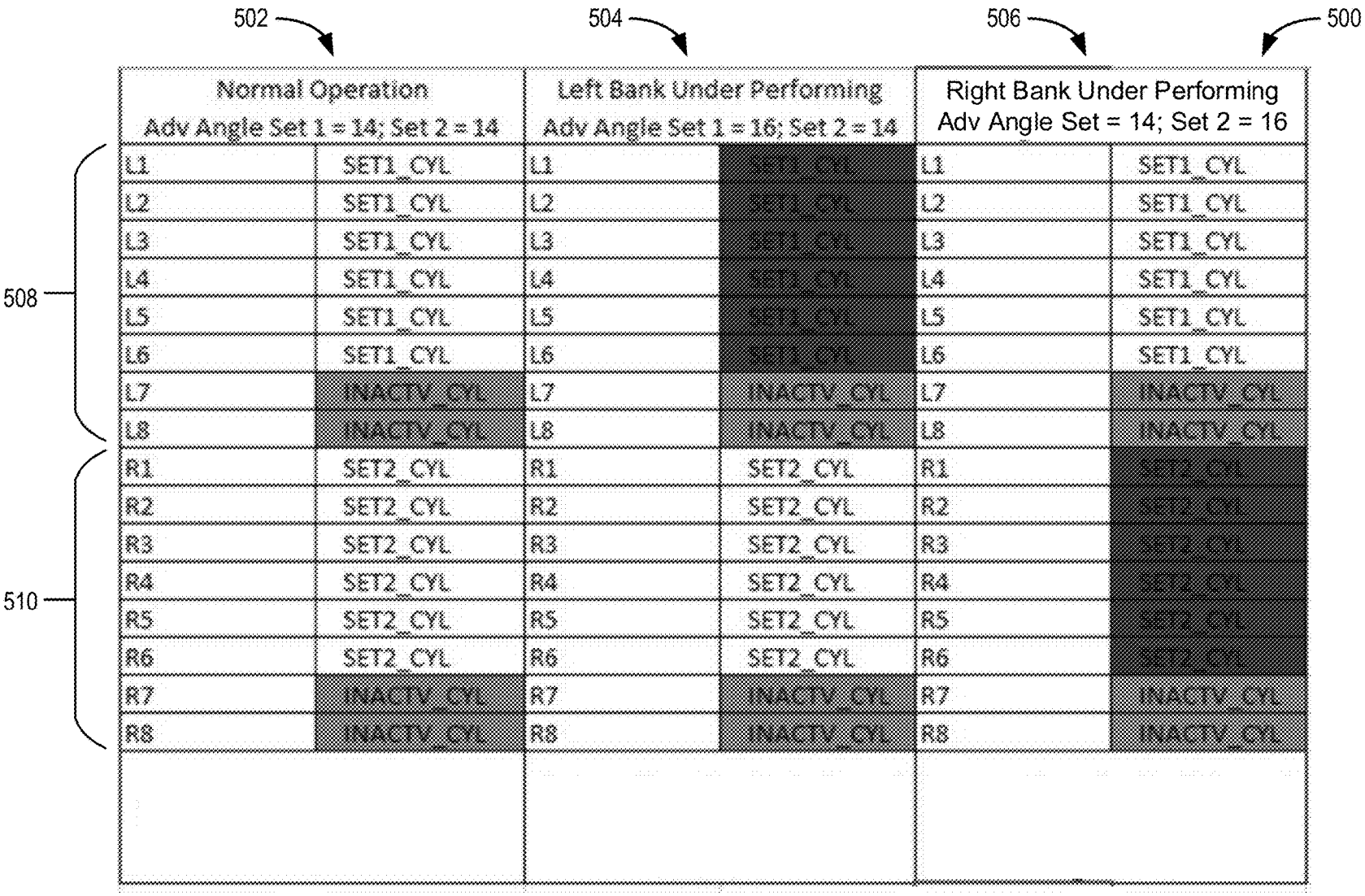
FIG. 5 shows an example of adjusting fueling timing to engine cylinders based on engine operating conditions.

FIG. 5 shows a second example table 500 of adjusting fueling in a cylinder bank based on operating conditions of both cylinder banks. A first group of rows designated by 508 may include eight cylinders belonging to a first cylinder bank (such as cylinder bank 62 in FIG. 1) and a second group of rows designated by 510 may include another eight cylinders belonging to a second cylinder bank (such as cylinder bank 64 in FIG. 1). The cylinders in the first bank are denoted by L1-L6 and the cylinders in the second bank are denoted by R1-R6. In this example, additional cylinders L7-L8 (in first bank) and cylinders R7-R8 (in second bank) are shown as inactive cylinders that are not fueled for power generation. The first column 502 of the table 500 shows operation of the engine cylinders when both cylinder banks are operating under similar operating conditions without any indication of degradation or power imbalance between banks. The second column 504 of the table 500 shows a first adjustment to injection timing of the engine cylinders in response to the first cylinder bank underperforming relative to the second cylinder bank causing power imbalance between the two banks. The third column 506 of the table 500 shows a second adjustment to injection timing of the engine cylinders in response to the second cylinder bank underperforming relative to the first cylinder bank causing power imbalance between the two banks.

As shown in the first column 502, cylinders L1-L6 are grouped as a first set (set 1) of cylinders and cylinders R1-R6 are grouped as a second set (set 2) of cylinders based on the positioning of the cylinders in the engine banks. Since both cylinder banks operate uniformly, injection timing is not altered. Injection timing may be measured relative to a top dead center (TDC) position of the piston in a cylinder. An increase in power output of a cylinder may be achieved by advancing fuel injection timing relative to TDC. All cylinders in both first and second set may be injected with fuel via fuel injectors coupled to the respective cylinders at 14 dB TDC. In a diesel powered engine, the injection timing may correspond to the ignition timing, as the air-fuel mixture may be ignited upon fuel injection.

As shown in second column 504, injection timing in the engine cylinders may be adjusted due to the first cylinder bank underperforming such as the power output of the first bank being lower than desired. The underperformance of the one engine bank while the other bank continues to operate optimally may arise due to degradation of a component (such as turbocharger, intercooler etc.) coupled to the underperforming bank. All the cylinders, L1-L6, are grouped together as first set (set 1) and all cylinders of the second bank, R1-R6, are grouped together as second set (set 2).

The cylinders in set 1 (first bank cylinders) may be operated with an advanced injection timing of 16 dB TDC while the cylinders of set 2 (second bank cylinders) may be operated with an injection timing of 14 dB TDC. The level of advancement of the injection timing for the first set relative to the second set may be determined as a function of a difference in power output of the first bank relative to the second bank as estimated based on sensor outputs (such as exhaust temperature sensor, MAP, etc.) from each of the first bank and the second bank. An increase in torque/fuel fraction is proportional to an increase in the amount of fuel injected. An increase in power output of the first set of cylinders (first bank) may be achieved by advancing fuel injection timing relative to TDC (from 14 dB TDC to 16 dB TDC), thereby offsetting the underperformance of the first bank cylinders. In this way, by selectively advancing injection timing for one cylinder bank, power balance between cylinders may be attained.

As shown in second column 506, injection timing in the engine cylinders may be adjusted due to the second cylinder bank underperforming such as the power output of the second bank being lower than desired. All the cylinders, L1-L6, of the first bank are grouped together as first set (set 1) and all cylinders of the second bank, R1-R6, are grouped together as second set (set 2).

The cylinders in set 2 (second bank cylinders) may be operated with an advanced injection timing of 16 dB TDC while the cylinders of set 1 (first bank cylinders) may be operated with an injection timing of 16 dB TDC. The level of advancement of the injection timing for the second set relative to the first set may be determined as a function of a difference in power output of the second bank relative to the first bank as estimated based on sensor outputs (such as exhaust temperature sensor, MAP, etc.) from each of the first bank and the second bank. An increase in torque/fuel fraction is proportional to an increase in the amount of fuel injected. An increase in power output of the second set of cylinders (second bank) may be achieved by advancing fuel injection timing relative to TDC (from 14 dB TDC to 16 dB TDC), thereby offsetting the underperformance of the second bank cylinders.

In this way, responding to the engine operating conditions not matching at least one of a plurality of predetermined override, operating conditions of the first cylinder bank may be compared to operating conditions of the second cylinder bank. In response to a difference in at least one operating condition between the first cylinder bank and the second cylinder bank, adjusting at least a first operating parameter of the first cylinder set may be adjusted to a first value and at least the first operating parameter of the second cylinder set may be adjusted to a second value (the first value being not equal to the second value) to mitigate the difference in output of the two engine banks.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method, comprising:

assigning a first plurality of cylinders of a first cylinder bank to a first cylinder set, wherein the first cylinder bank comprises a first intake manifold;

assigning a second plurality of cylinders of a second cylinder bank to a second cylinder set, wherein the second cylinder bank comprises a second intake manifold separate from the first intake manifold;

estimating engine operating conditions;

comparing the engine operating conditions against a plurality of predetermined override conditions; and responding to the engine operating conditions matching a predetermined override condition of the plurality of predetermined override conditions by:

reassigning at least a first cylinder of the first plurality of cylinders of the first cylinder bank to the second cylinder set; and adjusting an operating parameter of each of the first and second cylinder sets based on the predetermined override condition, wherein the predetermined override condition comprises an exhaust port of the first cylinder decreasing to below a temperature threshold.

2. The method of claim 1, wherein adjusting the operating parameter of each of the first and second cylinder sets based on the predetermined override condition comprises increasing a rate of fuel delivery to the second cylinder set.

3. The method of claim 1, wherein the plurality of predetermined override conditions further comprise a dynamic skip-fire request, and wherein adjusting the operating parameter of each of the first and second cylinder sets based on the predetermined override condition comprises ceasing fuel delivery to the second cylinder set.

4. The method of claim 1, wherein responding to the engine operating conditions matching the predetermined override condition further includes reassigning at least a second cylinder of the second plurality of cylinders of the second cylinder bank to the first cylinder set.

5. The method of claim 1, wherein reassigning at least the first cylinder of the first plurality of cylinders of the first cylinder bank to the second cylinder set comprises retrieving a vector of cylinder assignments from a location of non-transitory memory associated with the predetermined override condition, the vector of cylinder assignments including a plurality of entries, each of the plurality of entries indicating a set assignment for a corresponding cylinder of the first plurality of cylinders and the second plurality of cylinders.

6. The method of claim 1, further comprising:

responding to the engine operating conditions not matching at least one of the plurality of predetermined override conditions by comparing operating conditions of the first cylinder bank with operating conditions of the second cylinder bank; and responding to a difference in at least one operating condition between the first cylinder bank and the second cylinder bank by adjusting at least a first operating parameter of the first cylinder set to a first value and adjusting at least the first operating parameter of the second cylinder set to a second value, wherein the first value is not equal to the second value.

7. The method of claim 6, wherein comparing operating conditions of the first cylinder bank with operating conditions of the second cylinder bank includes comparing one of a manifold intake pressure and a manifold intake temperature corresponding to the first intake manifold of the first cylinder bank against one of a manifold intake pressure and a manifold intake temperature corresponding to the second intake manifold of the second cylinder bank, respectively.

8. The method of claim 6, wherein comparing operating conditions of the first cylinder bank with operating conditions of the second cylinder bank includes comparing one or more of a turbocharger speed and a pre-turbine temperature corresponding to the first cylinder bank to one or more of a turbocharger speed and a pre-turbine temperature corresponding to the second cylinder bank.

9. The method of claim 6, wherein the first operating parameter comprises one or more of an air/fuel ratio, a fueling rate, and a cylinder valve timing offset.

10. A system for an engine, the system comprising:

a first cylinder bank comprising a first plurality of cylinders;

a second cylinder bank comprising a second plurality of cylinders;

a first intake manifold configured to provide air to the first cylinder bank;

a second intake manifold configured to provide air to the second cylinder bank;

a first exhaust manifold coupled to the first cylinder bank;

a second exhaust manifold coupled to the second cylinder bank; and a controller with computer readable instructions stored on non-transitory memory that when executed during operation of the engine cause the controller to:

estimate engine operating conditions of the first cylinder bank and the second cylinder bank;

compare the engine operating conditions of the first cylinder bank and the second cylinder bank against a plurality of predetermined override conditions; and respond to the engine operating conditions of the first cylinder bank and the second cylinder bank matching a predetermined override condition of the plurality of predetermined override conditions by:

reassigning at least a the first cylinder of the first plurality of cylinders of the first cylinder bank from a first cylinder set to a second cylinder set; and adjusting an operating parameter of each of the first and second cylinder sets based on the predetermined override condition, wherein the predetermined override condition comprises an exhaust port of a first cylinder of the first plurality of cylinders of the first cylinder bank decreasing to below a temperature threshold.

11. The system of claim 10, wherein the first plurality of cylinders includes all cylinders of the first cylinder bank, and wherein the second plurality of cylinders includes all cylinders of the second cylinder bank.

12. The system of claim 10, wherein the computer readable instructions further cause the controller to, upon engine-startup of the engine:

assign the first plurality of cylinders of the first cylinder bank to the first cylinder set; and assign the second plurality of cylinders of the second cylinder bank to the second cylinder set.

13. A method for an engine, the method comprising:

responding to startup of the engine by:

assigning all cylinders of a first cylinder bank to a first cylinder set; and assigning all cylinders of a second cylinder bank to a second cylinder set;

comparing engine operating conditions against a plurality of predetermined override conditions; and responding to the engine operating conditions matching a predetermined override condition of the plurality of predetermined override conditions by:

reassigning at least a first cylinder of the first cylinder bank to the second cylinder set; and adjusting an operating parameter of each of the first and second cylinder sets based on the predetermined override condition, wherein the predetermined override condition comprises an exhaust port of the first cylinder decreasing to below a temperature threshold.

14. The method of claim 13, wherein the first cylinder bank includes a first intake manifold and a first exhaust manifold, and wherein the second cylinder bank includes a second intake manifold and a second exhaust manifold, wherein the first intake manifold and the second intake manifold are fluidically uncoupled, and wherein the first exhaust manifold and the second exhaust manifold are fluidically uncoupled.

15. The method of claim 14, further comprising:

responding to the engine operating conditions not matching at least one of the plurality of predetermined override conditions by comparing operating conditions of the first cylinder bank with operating conditions of the second cylinder bank; and responding to a difference in at least one operating condition between the first cylinder bank and the second cylinder bank by adjusting at least a first operating parameter of the first cylinder set to a first value and adjusting at least the first operating parameter of the second cylinder set to a second value, wherein the first value is not equal to the second value.

16. The method of claim 15, wherein comparing operating conditions of the first cylinder bank with operating conditions of the second cylinder bank comprises one or more of:

comparing a first intake air flowrate of the first intake manifold of the first cylinder bank with a second intake air flowrate of the second intake manifold of the second cylinder bank;

comparing a first torque output of the first cylinder bank with a second torque output of the second cylinder bank; and comparing a first exhaust temperature of the first exhaust manifold of the first cylinder bank with a second exhaust temperature of the second exhaust manifold of the second cylinder bank.

17. The method of claim 16, wherein adjusting at least the first operating parameter of the first cylinder set to the first value and adjusting at least the first operating parameter of the second cylinder set to the second value comprises decreasing a fueling rate of the first cylinder set to the first value in response to a first power output of the first cylinder bank being greater than a second power output of the second cylinder set.

18. The method of claim 16, wherein adjusting at least the first operating parameter of the first cylinder set to the first value and adjusting at least the first operating parameter of the second cylinder set to the second value comprises adjusting an injection timing of the first cylinder set to the first value in response to a first power output of the first cylinder bank being different than a second power output of the second cylinder set.

19. The method of claim 13, further comprising:

responding to the engine operating conditions matching the predetermined override condition of the plurality of predetermined override conditions by:

reassigning a third cylinder of the first cylinder bank to a third cylinder set; and adjusting operating parameters of the first cylinder set, the second cylinder set, and the third cylinder set independently based on the predetermined override condition.

20. The method of claim 13, further comprising reassigning the first cylinder of the first cylinder bank from the second cylinder set to the first cylinder set responsive to the engine operating conditions no longer matching the predetermined override condition.

* * * * *